US011221109B2

(12) United States Patent
Ge

(10) Patent No.: US 11,221,109 B2
(45) Date of Patent: Jan. 11, 2022

(54) FILAMENT STRUCTURE AND BULB HAVING THE FILAMENT STRUCTURE

(71) Applicant: Tiehan Ge, Hangzhou (CN)

(72) Inventor: Tiehan Ge, Hangzhou (CN)

( * ) Notice: Subject to any disclaimer, the term of this patent is extended or adjusted under 35 U.S.C. 154(b) by 0 days.

(21) Appl. No.: 17/051,289

(22) PCT Filed: Jun. 18, 2019

(86) PCT No.: PCT/CN2019/091647
§ 371 (c)(1),
(2) Date: Oct. 28, 2020

(87) PCT Pub. No.: WO2019/242596
PCT Pub. Date: Dec. 26, 2019

(65) Prior Publication Data

US 2021/0199250 A1 Jul. 1, 2021

(30) Foreign Application Priority Data

Jun. 23, 2018 (CN) ..... 201810668630.4

(51) Int. Cl.
*F21K 9/232* (2016.01)
*F21V 19/00* (2006.01)
*F21Y 115/10* (2016.01)

(52) U.S. Cl.
CPC ..... *F21K 9/232* (2016.08); *F21V 19/0025* (2013.01); *F21Y 2115/10* (2016.08)

(58) Field of Classification Search
CPC .. F21K 9/232; F21V 19/0025; F21Y 2115/10; F21Y 2107/70; F21S 4/22; F21S 4/24; H05K 1/189
See application file for complete search history.

(56) References Cited

U.S. PATENT DOCUMENTS 10,026,874 B1 * 7/2018 Li ..... H01L 33/504
10,436,391 B2 * 10/2019 Hsiao ..... F21V 21/14
(Continued)

FOREIGN PATENT DOCUMENTS

CN 203500919 * 3/2014 ..... F21V 23/00
CN 203500919 U 3/2014
(Continued)

OTHER PUBLICATIONS

Zhou, Power hidden LED (Light Emitting Diode) bulb, Mar. 26, 2014, English Translation of Description of Chinese patent (Year: 2014).*
(Continued)

*Primary Examiner* — Peggy A Neils
(74) *Attorney, Agent, or Firm* — Getech Law LLC; Jun Ye

(57) ABSTRACT

A filament structure and a bulb having the filament structure. The filament structure comprises at least three filament substrates. Each of the at least three filament substrates has a first end and a second end spaced apart from each other. Respective sections between the first ends and the second ends of the at least three filament substrates rotatably extend around an axis. An angle at which the sections of the at least three filament substrates between the first ends and the second ends are wound around the axis is not greater than 720 degrees. The filament structure and the bulb having the filament structure are convenient to process and install, achieve multi-angle omni-directional illumination, and meet the requirements of heat dissipation. The filament structure has an attractive appearance that is easily used for decoration.

13 Claims, 8 Drawing Sheets

(56) References Cited

U.S. PATENT DOCUMENTS

| | | | | |
|---|---|---|---|---|
| 2016/0377237 | A1* | 12/2016 | Zhang | H01L 33/62 362/311.02 |
| 2017/0241597 | A1 | 8/2017 | Yeung | |
| 2019/0226643 | A1* | 7/2019 | Zheng | F21K 9/232 |
| 2019/0323695 | A1* | 10/2019 | Wu | F21V 23/003 |
| 2020/0132257 | A1* | 4/2020 | Hong | F21V 23/06 |

FOREIGN PATENT DOCUMENTS

| | | | |
|---|---|---|---|
| CN | 203797394 | U | 8/2014 |
| CN | 204187337 | U | 3/2015 |
| CN | 205001912 | U | 1/2016 |
| CN | 108799863 | A | 11/2018 |
| CN | 108826041 | A | 11/2018 |
| JP | 2013225587 | A | 10/2013 |

OTHER PUBLICATIONS

PCT/CN2019/091647—International Search Report, dated Sep. 19, 2019, 6 pages.

* cited by examiner

FILAMENT STRUCTURE AND BULB HAVING THE FILAMENT STRUCTURE

TECHNICAL FIELD

The present disclosure relates to an LED lighting device, in particular to an LED filament structure and a bulb having the same.

BACKGROUND

As an emerging light source, LED has been widely used in the household and commercial lighting, and has gradually become a commonly used light source in daily life. However, the LED light source has the characteristics of high directivity and high heat generation. Therefore, it is difficult to apply to the small-sized bulb. In order to obtain omni-directional light emission, more LED light-emitting elements must be installed, which in turn requires a larger volume for heat dissipation. Therefore, the existing LED light source has either larger volume or lower brightness due to the limitation of its heat generation and volume restrictions.

In the prior art, there are different types of LED package, including Lamp type, Chip On Boardtype, Surface Mount Device type, System In Package type, etc. According to different types of LED package, different package substrates are used.

In general, the substrate for the Chip-On-Board LED package is a circuit board or a substrate made of a single material, such as metal, PVC, organic glass, plastic, etc., and the shape of the substrate is generally flat rectangle, flat circle or flat strip, etc. Furthermore, the edges of these substrates are usually smooth straight lines or curves.

After setting the LED chip on the substrate and applying the fluorescent glue, the light is emitted is a plane light. Even if a three-dimensional luminous body is formed by one or more substrates, the luminous body is likely to have uneven lighting angles distribution as the overall structure is hard to be designed perfectly. In addition, although the substrate can emit light in 360 degrees when it is made from light-transmitting material, the heat dissipation problems are usually caused. On the contrary, when the substrate is made of an opaque material, such as metal, there is no light emitting from the side where the LED chip is not provided, resulting in the inability to emit light in 360 degrees.

In conclusion, the current Chip-On-Board LED package has an uneven light-emitting angles distribution, which makes it impossible to emit lights in multi-angle or multi-level. Additionally, the heat dissipation problem usually occurs and thus the light efficiency may be affected. Therefore, there is an urgent need to develop a high-efficiency LED package substrate that is equipped with LED chips and sealed with fluorescent glue, has a balanced light-emitting angle, completely multi-angle, multi-level light, and is easy to install and process.

SUMMARY

The technical problem to be solved by the present invention is to provide an LED filament structure and a bulb having the same, which is convenient for processing and installation, has good heat dissipation effect, and can provide uniform light emission in all directions and multiple angles.

In order to solve the above-mentioned technical problems, the following technical solution is adopted: A filament structure comprising at least three filament substrates, characterized in that: each of the at least three filament substrates has a first end and a second end which are spaced apart from each other; sections between the first ends and the second ends of the at least three filament substrates extend and wind around an axis respectively; and an angle at which the sections of the at least three filament substrates between the first ends and the second ends are wound around the axis is not greater than 720 degrees.

Preferably, each of the at least three filament substrates includes at least one substrate stripe, and the at least one substrate stripe extends between the first end and the second end in a fold line, a curved line, a wavy line, or an irregular line.

In order to make the stretch easier to operate and avoid the filament substrate from being broken during pulling, the width of the at least one substrate stripe increases gradually or decreases gradually between the first end and the second end.

Preferably, the first ends of the at least three filament substrates are located in a first plane, the second ends of the at least three filament substrates are located in a second plane, and the first plane and the second plane are parallel or not parallel to each other.

Preferably, at least one of the first ends and the second ends of the at least three filament substrates are connected to a connector, or at least one of the first ends and the second ends of the at least three filament substrates are connected to each other.

Preferably, the first ends and the second ends of the at least three filament substrates are respectively connected to a first connector provided in the first plane and a second connector provided in the second plane; and the first ends of the at least three filament substrates are all connected to the first connector and the second ends of the at least three filament substrates are all connected to the second connector.

Preferably, the first connector and the second connector are arranged coaxially and/or in parallel.

In order to facilitate processing and one-time stretching, the positions where the first ends of the at least three filament substrates are connected to the first connector are evenly or unevenly distributed along the circumferential direction of the first connector;

and the positions where the second ends of the at least three filament substrates are connected to the second connector are evenly or unevenly distributed along the circumferential direction of the second connector.

Preferably, the sections between the first ends and the second ends of the at least three filament substrates extend in a spiral smooth curve.

Preferably, the axis around which the sections between the first ends and the second ends of each of the at least three filament substrates extend and wind are parallel to each other, coincided, or at a certain angle.

Preferably, the at least three filament substrates are provided with a plurality of LED light-emitting elements, and the outside of the filament substrate and the LED light-emitting elements are covered with a medium layer serving for protection or light emitting.

A bulb comprising the above filament structure. The bulb comprises a lamp holder and a lamp post arranged on the lamp holder, the lamp post being connected to a positive and negative lead, and the bulb comprising at least one filament structure, characterized in that: the positive and negative lead is connected to at least one filament structure; and a light-transmitting lamp body is provided to house the lamp post and at least three filament substrates.

Preferably, the bulb comprises at least two filament structures. The first ends and/or the second ends of at least three filament substrates in the at least two filament structures are connected to each other.

Preferably, the first ends of at least three filament substrates in the two filament structures are connected to the first connector respectively; the second ends of at least three filament substrates in the two filament structures are connected to a second connector respectively; and the first connectors and/or the second connectors of the two filament structures are at least partially overlapped and connected.

Compared with the prior art, the advantage of the present invention lies in that: The filament structure and the bulb having the filament structure are convenient to process and install, achieve multi-angle omni-directional illumination, and meet the requirements of heat dissipation. The filament structure has an attractive appearance that is easily used for decoration. The structure also enables multiple light-emitting elements at a filament to form multiple structures connected in parallel or in series, separate or simultaneous control of the light-emitting elements, and realizes arrangement of light-emitting elements of multiple colors, thereby achieving multiple lighting effects.

DETAILED DESCRIPTION OF EMBODIMENTS

The invention will be described in further detail with reference to the accompanying drawings.

Figure 1:
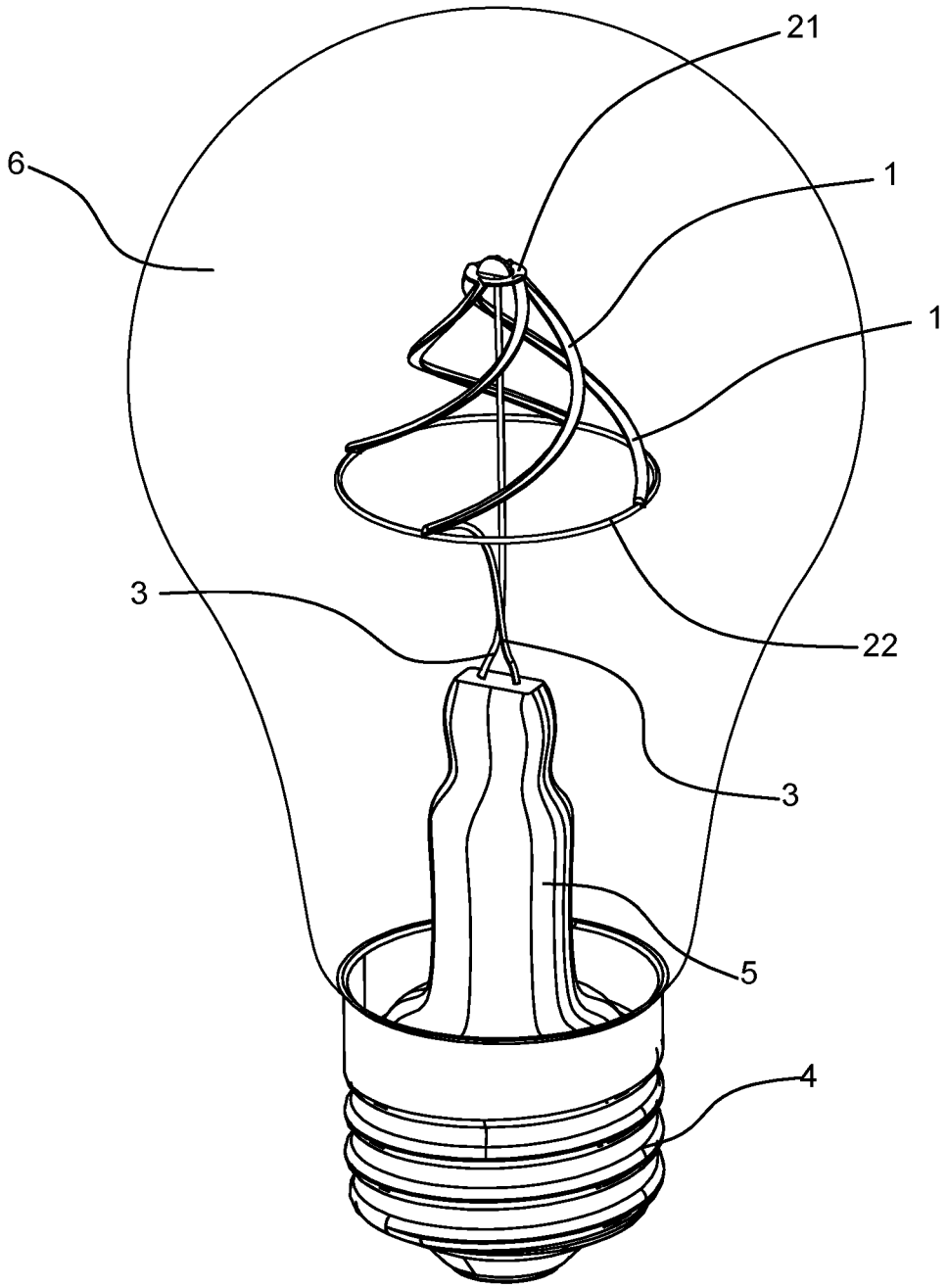
FIG. 1 schematically shows a three-dimensional structure of the bulb according to the first embodiment of the present invention.
Figure 2:
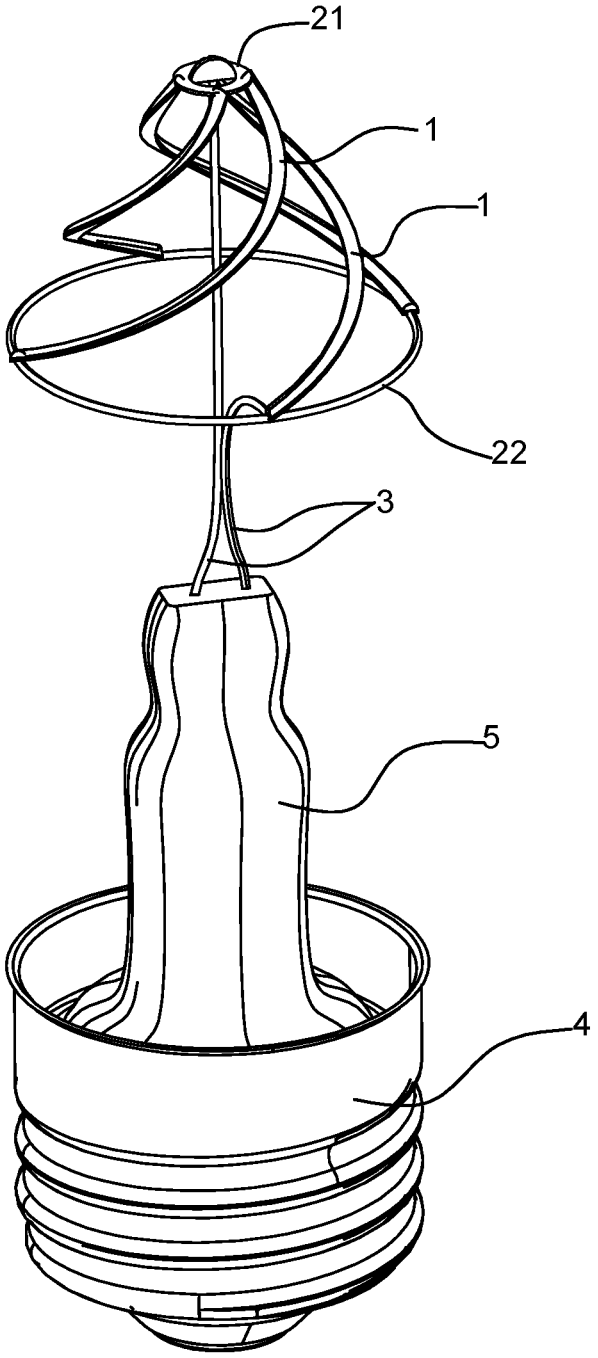
FIG. 2 schematically shows the filament structure according to the first embodiment of the present invention.
Figure 3:
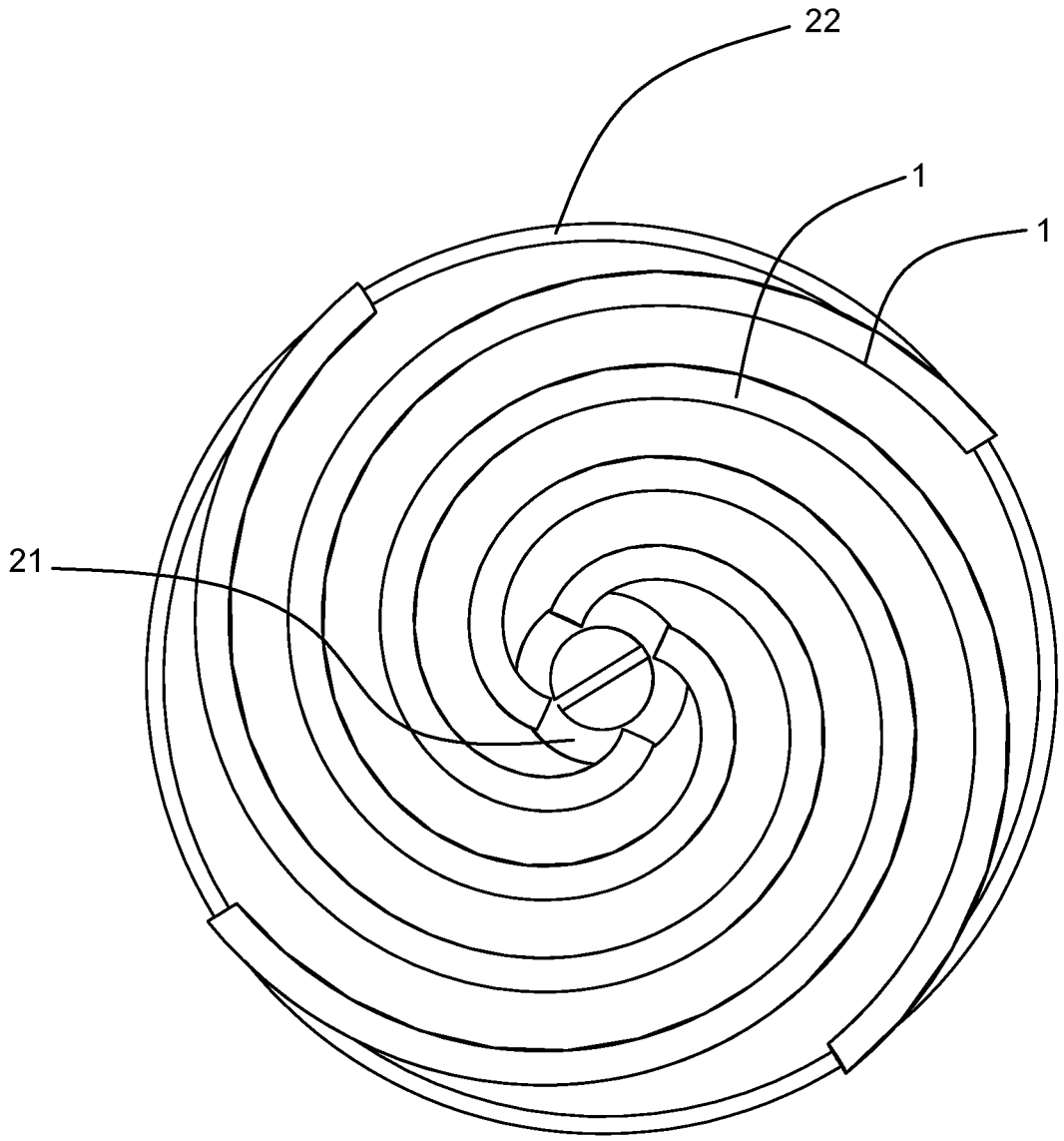
FIG. 3 schematically shows the plan view of the filament structure according to the first embodiment of the present invention before being stretched.

FIGS. 1-3 schematically shows the structure of a bulb having a filament structure according to the first embodiment of the present invention. As shown in FIGS. 1 and 2, the filament structure includes at least three filament substrates 1. The at least three filament substrates 1 each include a first end and a second end. The first end and the second end are used for connecting with the lead wire so as to supply power to the LED light-emitting element on the filament substrate 1.

Each of the at least three filament substrates 1 extends in the manner of winding around an axis. The angle at which the section of the filament substrate that is between the first end and the second end wound around the axis is not exceed 720 degrees. Preferably, the axes which the at least three filament substrates 1 are wound around coincide with each other. That is, the at least three filament substrates 1 are all wound around the same axis. Alternatively, the axes which the at least three filament substrates 1 are wound around are arranged parallel to each other or at a certain angle. The filament substrate 1 extends in a smooth curve around the axis between the first end and the second end, or extends in a fold line between the respective first end and second end.

The first end and the second end of the at least three filament substrates 1 are spaced apart from each other, so that the at least three filament substrates exhibit a spatial distribution. As shown in FIGS. 1-3, preferably, the at least three filament substrates each extend in a spiral smooth curve between the first end and the second end. Preferably, the first ends of the at least three filament substrates 1 are located in a first plane, and the second ends are located in a second plane. That is, the first ends of the at least three filament substrates 1 are all located in the same plane, and the second ends are all located on another same plane. The first plane and the second plane are separated from each other. The first plane and the second plane are parallel to each other, or may also be at a certain angle to each other.

In addition, at least one of the first and second end of the at least three filament substrates 1 are connected to each other. That is, the first ends are connected together or the second ends are connected together. Alternatively, the first ends are connected together while the second ends are connected together.

As shown in FIGS. 1-3, the first plane and the second plane are respectively provided with connectors, which are respectively connected to the ends of the filament substrate 1, namely the first end and the second end. The first plane is provided with a first connector 21, and the second plane is provided with a second connector 22. The first connector 21 connects the first ends of at least three filament substrates 1, and the second connector 22 connects the second ends of at least three filament substrates 1. Therefore, when the first connector 21 and the second connector 22 are respectively connected to the positive and negative leads 3, the at least three filament substrates 1 can be connected in parallel. It should be noted that, it is also possible that only one of the first connector 21 and the second connector 22 exist. That is, only the first or second ends of the at least three filament substrates 1 are connected to the connector, while the other one of the first or second ends may be separated freely. And in this embodiment, the axes which the at least three filament substrates 1 are wound around coincide with each other. That is, the at least three filament substrates 1 are wound around the same axis.

It should be noted that, other connection manner can also be used. For example, the first connector 21 or the second connector 22 can be configured to form a disconnection, so that the first connector 21 or the second connector 22 respectively forms two portions disconnected with each other. Each portion is connected to at least one filament substrate 1, and each portion is connected to different leads, so that the at least three substrates 1 can be connected in series or in parallel with each other. The user can arrange the at least three filament substrates 1 as needed in different manners of connection.

The at least three filament substrates 1 can be provided with multiple LED light-emitting elements. The multiple LED light-emitting elements can be connected in parallel or in series with each other. The material of the filament substrate 1 includes but is not limited to metal, organic glass, PVC, plastic, sapphire, ceramic and silica gel. The filament substrate 1 may be formed from one of the materials as described above, or may be fabricated by splicing and/or embedding from multiple materials in the materials as described above. The filament substrate 1 may also be PCB or FPCB, etc. The LED light-emitting element can be an LED chip, or an LED lamp bead or other packaged LED light-emitting unit. The LED chip can be a vertical chip, a horizontal chip, a white light chip or a flip chip. Furthermore, the LED light-emitting element of the filament substrate 1 can be fixed on the filament substrate 1 with transparent glue, conductive glue (such as silica gel, modified resin, epoxy resin, silver glue or copper glue), and then the LED light-emitting elements can be connected in series or in parallel through the chip connecting wires arranged on the filament substrate 1 or the wires preformed on the filament substrate 1. The outside of the LED light-emitting element may also be coated with a transparent medium layer serving for protection or light emitting. The material of the transparent medium layer is one of silica gel, epoxy resin and LED light-emitting powder glue, or the combination of some of them.

Figure 8:
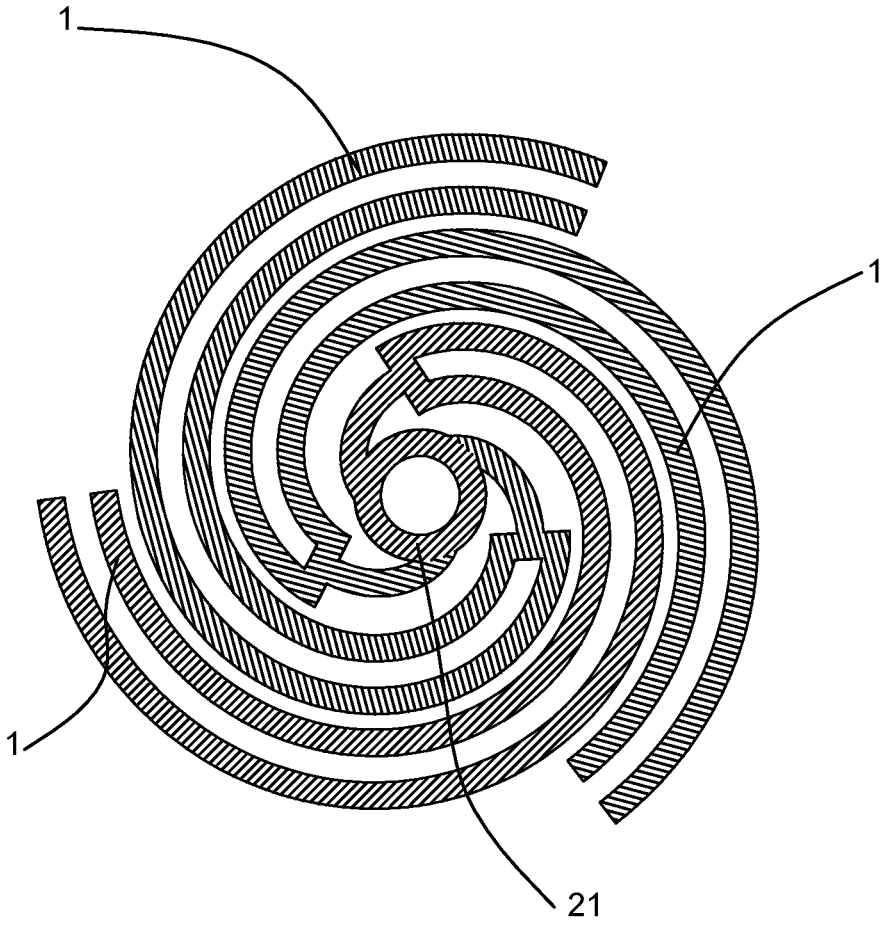
FIG. 8 shows another alternative embodiment of the filament structure of the present invention.

Each of the at least three filament substrates 1 includes at least one substrate stripe. Each substrate stripe may extend along the same curved line or fold line, or wavy line, or irregular line, such as the irregular line including partial fold line and partial curved line. The at least one substrate stripe can extend long a spiral curve as shown in FIGS. 1-3, or other curved line, such as a regular or irregular wavy line, a circular arc line, or a fold line (such as a fold line folded back and forth, or a fold line folded sequentially in one direction). The at least one substrate stripe are spaced apart from each other in a three-dimensional space. When each filament substrate has at least two substrates stripes, the at least two substrates stripes are connected to each other, which may be partially overlapped or not overlapped, or connected at one end or connected at both ends, so that after the three-dimensional filament structure is formed, more spatial distribution shapes can be formed. In this way, the filament structure can present a variety of different styles spatially and can be spatially distributed more evenly, thereby making the illumination of the filament structure more uniform, omni-directional and multi-angle. The more substrates stripes the filament substrate includes, the more uniform and omni-directional the spatial distribution of light-emitting points is, after forming the three-dimensional structure. The multiple substrate stripes in each filament substrate can extend and wind around the same axis. As shown in FIG. 8, the filament structure includes three filament substrates 1. Each of the three filament substrates 1 includes two substrate stripes. The first ends of the three filament substrates 1 are connected to the first connector 21. The second ends of the filament substrate 1 are separated from each other.

Preferably, the at least three filament substrates each includes at least one substrate stripes, and the width of the at least one substrate stripes gradually increases or decreases from the first end to the second end. Preferably, the width is gradually increased as the substrate stripe extends. This arrangement makes it more convenient and the overall structure stronger when the at least three filament substrates 1 are stretched from a plane into a three-dimensional structure. In addition, during the stretching process, the filament substrate can be under a balanced force in the radial direction, so that the filament substrate is stretched under an uniform tensile force.

FIGS. 1 and 2 schematically shows a bulb with the filament structure. The bulb includes a lamp holder 4 and a lamp post 5 arranged on the lamp holder 4. The lamp post 5 is connected to the positive and negative leads 3, and the positive and negative leads 3 are respectively connected to the first and second ends of the at least three filament substrates. The positive and negative leads 3, the lamp post 5 and the at least three filament substrates 1 are housed in a light-transmitting lamp body 6, and the bottom of the light-transmitting lamp body 6 is fixedly connected to the lamp holder 4. As shown in FIGS. 1 and 2, the first connector 21 and the second connector 22 are parallel to each other, and the first connector 21 is located above the second connector 22. The at least three filament substrates 1 include four filament substrates 1. The first end of each filament substrate is connected to the first connector 21, and the second end of each filament substrate is connected to the second connector 22. The positive and negative leads 3 are respectively connected to the first connector 21 and the second connector 22. The section of the at least three filament substrates 1 that extends spirally between the first end and the second end. The lamp holder 4 is provided with an electric connector and a driver for connecting with an external power source and supplying power to the filament structure through the lamp post and the positive and negative leads.

FIG. 3 schematically shows the at least three filament substrates of this embodiment before processing. As shown in FIG. 3, the first connector 21, the second connector 22, and the at least three filament substrates 1 are all located in the same plane. The first connector 21 and the second connector 22 are both ring-shaped members. The first connector 21 is arranged on the inner side of the second connector 22 in the radial direction and spaced apart from the second connector 22. The at least three filament substrates 1 are arranged between the first connector 21 and the second connector 22. That is, the at least three filament substrates 1 are all located in the same plane, and the first ends of the at least three filament substrates 1 are located on the inner side of the second ends in the radial direction. The at least three filament substrates 1 extends between the first end and the second end. Preferably, the at least three filament substrates 1 extend spirally around the first connector 21 with intervals therebetween. That is, the at least three filament substrates 1 all extend and wind around a point, and the at least three filament substrates 1 all wind around the same point, namely, the center of the first connector 21. Therefore, to fabricate the filament structure, it only needs the processing performed in the same plane. For example, LED light-emitting elements, electrical connecting wires, and other packaging materials are applied on at least three filament substrates 1. After the processing, the filament structure with a three-dimensional structure can be stretched and formed at one time by simply stretching the first connector 21 and the second connector 22 apart from each other, without any unnecessary shaping and processing procedure. That is, the filament structure with a three-dimensional structure can be formed by simply stretching the first connector 21 and the second connector 22 apart into different planes. And those skilled in the art can also understand that the first connector 21 and the second connector 22 may also be components of other different structures, such as other solid structures like circular, square, etc., or other ring structures like elliptical ring, square ring, etc., or an arc-shaped structure.

Preferably, in this embodiment, the first connector 21 and the second connector 22 are coaxially arranged and both have a ring structure. The first plane and the second plane are parallel to each other after performing the stretching process. The position where the first ends of the four filament substrates 1 are connected to the first connector 21 are evenly distributed along the circumferential direction of the first connector 21, that is, the four filament substrates 1 are evenly distributed in the three-dimensional space. The position where the second ends of the four filament substrates 1 are connected to the second connector 22 are evenly distributed along the circumferential direction of the second connector 22. The four filament substrates 1 are distributed spirally around the first connector 21 between the first connector 21 and the second connector 22. The four filament substrates 1 are arranged adjacently one after another.

Preferably, the first ends of the four filament substrates 1 are connected to the first connector 21, and the second ends of the four filament substrates 1 are separated from each other. That is, the second connector 22 can be omitted, so that during the processing, the four filament substrates 1 and the first connector 21 can be processed as a whole, following with the step of integrally packaging and then the step of stretching. The whole three-dimensional shape can be formed at one time by simply pulling the first connector 21 out of the plane.

It should be noted that, the filament structure does not necessarily adopt the above-mentioned manufacturing method. For example, the filament structure can be configured such that the first connector 21 and the second connector 22 have the same ring structure and they may also be located respectively in different planes originally. Then, the filament substrates are connected to the first connector 21 and the second connector 22 respectively. In the above method, the first connector 21 is placed on the inside of the second connector 22 in radial direction and is to be stretched. The processed three-dimensional filament structure is a three-dimensional filament structure with a smaller radial size at one end and a larger radial size at the other end. The at least three filament substrates 1 all wind around an axis, and the angle at which the second end winds and extends relative to the first end does not exceed 720 degrees. That is, the at least three filament substrates 1 winds around the axis no more than two turns. As shown in FIGS. 1-3. the angle at which the section between the second end and the first end winds around the axis is about 270 degrees. In this way, more substrates is allowed to be set in a certain area during processing, and it may facilitate the convenience and efficient as well as structure stability when the filament is stretched out of a flat structure into a three dimensional structure. Preferably, the angle which the second end runs relative to the first end is greater than or equal to 90 degrees and less than or equal to 360 degrees. Preferably, when the at least three filament substrates are located in a plane and have not been stretched, the first end is located on the inside of the second end in the radial direction.

With such a filament structure, it is convenient to process. Additionally, the filament structure extends in a curved line or fold line between the first plane and the second plane, which can form a three-dimensional filament distribution structure, resulting uniform, multiple-angle and omni-directional light emitting. Moreover, the filament has a small structure and is distributed spatially. The LED light-emitting elements arranged on the filament substrate can facilitate heat dissipation, enabling both multi-angle and omni-directional illumination and heat dissipation. In addition, the filament structure can be easily processed and produced, and has an attractive appearance which may be a good decoration and have a great practicability.

Moreover, in the above-mentioned embodiment, since multiple filament substrates are provided, different LED light-emitting elements can be provided on each filament substrate and may be controlled individually. Therefore, individual control and layout may be performed with regard to multiple colors and multiple types of lamps, realizing a variety of lighting effects and lighting control.

Figure 4:
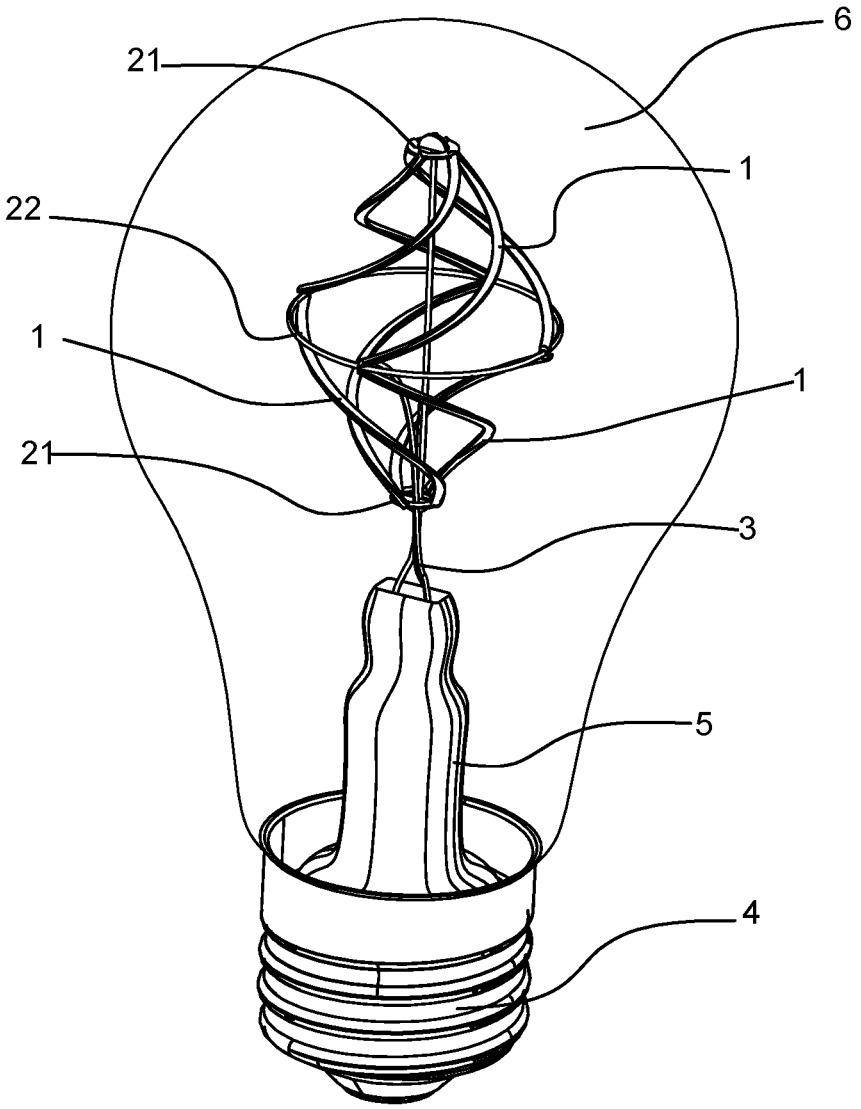
FIG. 4 schematically shows a three-dimensional structure of the bulb according to a second embodiment of the present invention.
Figure 5:
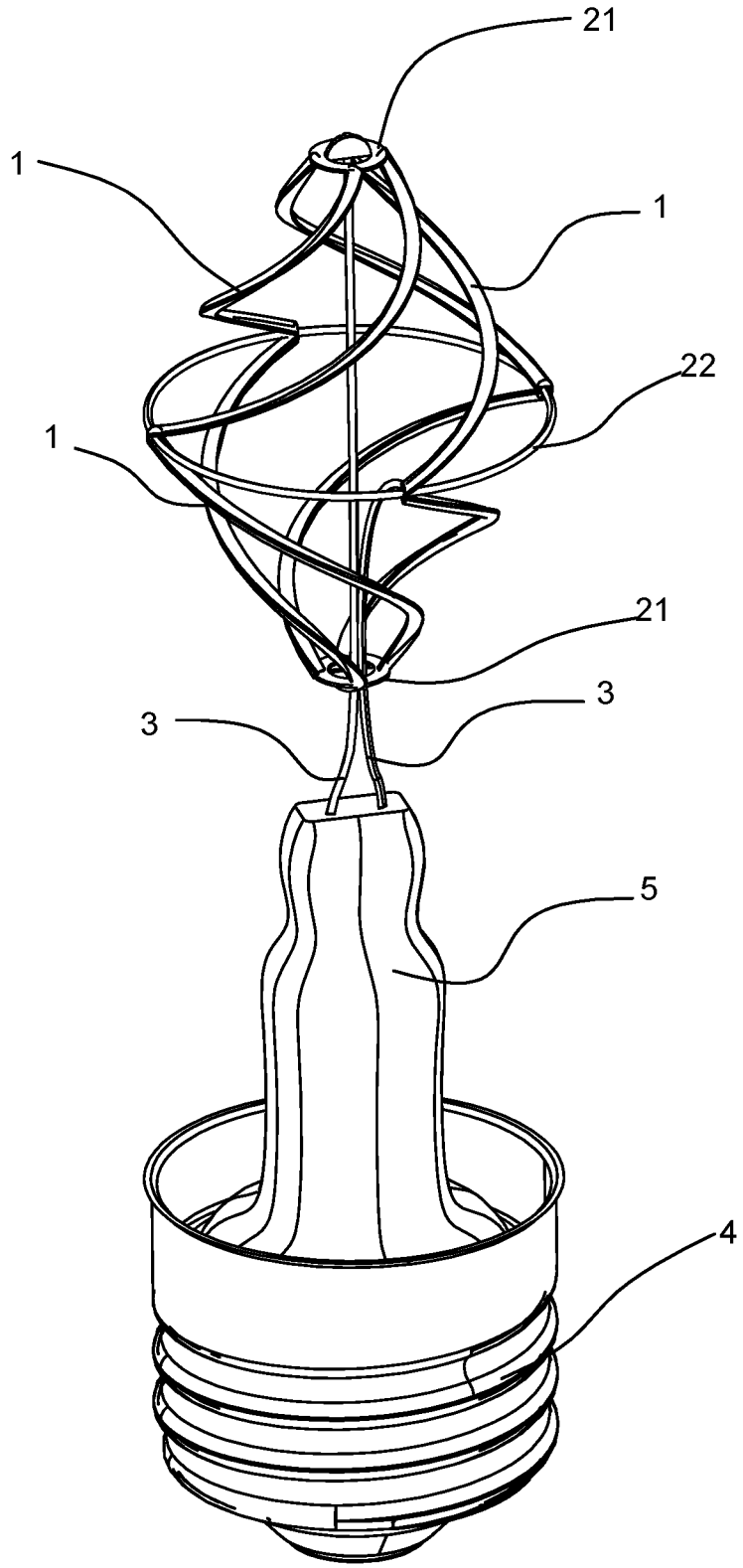
FIG. 5 schematically shows a structure of the bulb according to the second embodiment of the present invention.

FIGS. 4 and 5 schematically shows the bulb of the second embodiment of the invention. Similar to the first embodiment, the bulb includes a lamp holder 4, a lamp post 5 arranged on the lamp holder 4 and connected with positive and negative leads 3, and at least one filament structure which are connected to the positive and negative leads 3. The positive and negative leads 3, the lamp post 5 and the filament substrates are housed in a light-transmitting lamp body 6, and the bottom of the light-transmitting lamp body 6 is fixedly connected to the lamp holder 4. The bulb includes at least one filament structure, and the connector in the filament structure is connected with the positive and negative leads 3. FIGS. 4 and 5 shows two filament structures. Each filament structure is the same as in the first embodiment. In the two filament structures, one of the first connector and the second connector is integrated. That is, the second ends of the two filament structures are connected together, namely, the second connectors 22 of the two filament structures coincide with each other, or the two filament structures have a common second connectors 22. The two filament structures in the bulb forms a combination of two spiral structures that gradually increases in radial direction and then gradually decreases in radial direction. In this embodiment, there is only one common second connector 22. The positions where the second end of each filament substrate in the upper filament structure is connected to the second connector 22 respectively correspond to the positions where the second end of each filament substrate in the lower filament structure is connected to the second connector 22. That is, the second ends of the at least three filament substrates 1 in the upper filament structure and the second ends of the at least three filament substrates 1 in the lower filament structure are connected to each other. The upper filament structure is the same as the lower filament structure. Certainly, those skilled in the art can also understand that the structure of the upper and lower filament structures may also be different.

It should be noted that, it may also be possible that the first ends of the at least three filament substrates in the two filament structures are connected to each other. That is, the first connectors coincide with each other or the two filament structures have a common first connector 21. Thus, a combination of two spiral structures, which gradually decreases in radial direction and then gradually increases in radial direction, is formed. It can also be possible that at least one of the first ends and the second ends of the at least three filament substrates in the two filament structures are located in the same plane. The connection between the filament structures may have a partial overlap or complete overlap, or the connection therebetween may be formed adjacently. Alternatively, both the first ends and the second ends are respectively located in the same plane with at least partial overlap or adjacent connection. That is, a plurality of filament structures arranged side by side are formed. The user can arbitrarily set the filament structure as required. Only two structures are exemplified above, and those skilled in the art can set this conversion according to different requirements.

Figure 6:
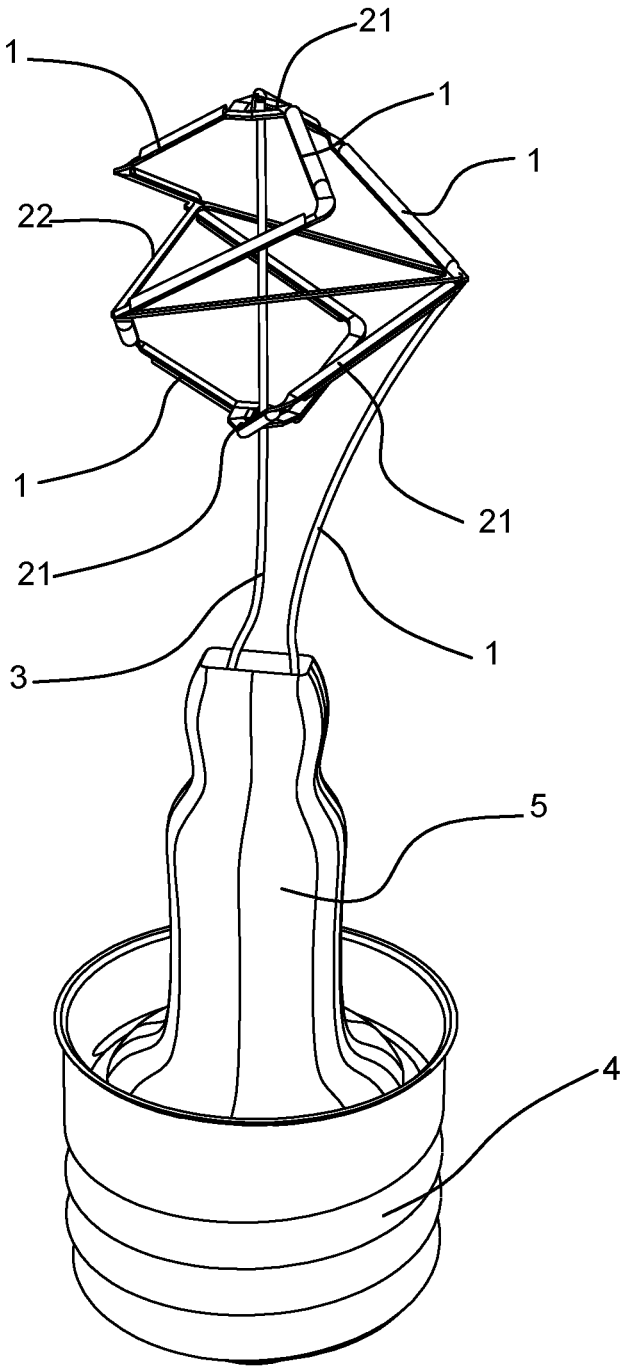
FIG. 6 schematically shows a structure of the bulb according to the third embodiment of the present invention.

FIG. 6 schematically shows the bulb of the third embodiment of the present disclosure. In this embodiment, the structure of the bulb is generally the same as that of the first and second embodiments, except for the filament structure. The bulb includes two filament structures. Each filament structure includes three filament substrates 1. Each filament substrate 1 includes a first end and a second end. Each filament substrate 1 includes a substrate strip. The substrate strip extends along a fold line, each substrate extends and winds around the axis. The section between the first end and the second end of the substrate winds around the axis for less than 90 degrees. The first ends of the three filament substrates 1 are all connected to the first connector 21, and the second ends of the three filament substrates are all connected to the second connector 22. The two filament structures have a common second connector 22. The first connectors 21 are arranged up and down separately, thus forming two filament structures that are inverted from each other. One of the positive and negative leads 3 of the bulb is respectively connected to the two first connectors 21 of the two filament structures, and the other one is connected to the common second connector 22 of the two filament structures. Moreover, in this embodiment, the substrate is in the shape of a fold line, and no LED light emitting element is provided in the bending area of the fold line. By such structure, the break and circuit failure is unlikely to occur after the filament substrates are stretched from a plane to a three-dimensional structure. Therefore, those skilled in the art can understand that the LED light-emitting elements can be arranged on the entire filament substrate uniformly, or arranged in partial areas, or in sub-regions. That is, the applied force during the filament stretching process can be guided to the area free of LED, so that the filament structure prevents damage to the LED light-emitting element due to twisting and bending during processing.

Figure 7:
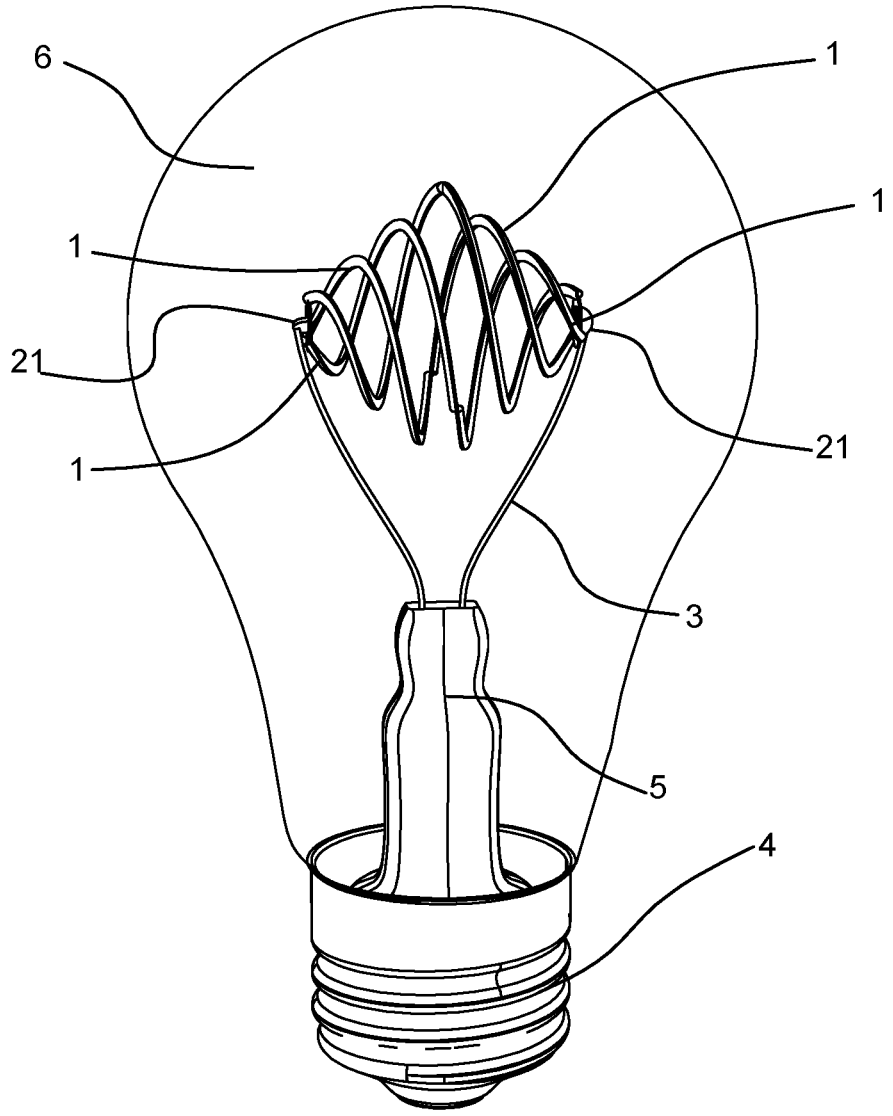
FIG. 7 schematically shows a structure of the bulb according to the fourth embodiment of the present invention.

FIG. 7 schematically shows the fourth embodiment of the present invention. Similarly to the bulbs in the first and second embodiments, the bulb includes a lamp holder 4 and a lamp post 5 arranged on the lamp holder 4. The lamp post 5 is connected to the positive and negative leads 3, and the positive and negative leads 3 are respectively connected to the first and second ends of the at least three filament substrates. The positive and negative leads 3, the lamp post 5 and the at least three filament substrates 1 are housed in a light-transmitting lamp body 6, and the bottom of the light-transmitting lamp body 6 is fixedly connected to the lamp holder 4. The difference lies in that this embodiment includes two above-mentioned filament structures, and the above-mentioned two filament structures are arranged horizontally. The two filament structures have only the first connector and do not have the second connector. Each of the two filament structures includes three uniformly distributed filament substrates 1. The second ends of the filament substrates 1 in the two filament structures are connected to each other. The first ends of the filament substrates 1 are all connected to the first connectors 21. The first connectors 21 of the two filament structures are respectively connected to the positive and negative electrodes in the positive and negative leads 3.

Therefore, it should be noted that various electrical connection methods are described in the above embodiments. It may be that only one of the first connector and the second connector is provided, or both the first connector and the second connector are provided. The first connector and the second connector are respectively connected to one of the positive and negative leads. That is, the first end and the second end are respectively connected to the positive and negative electrodes. Alternatively, when there are two or more filament structures, the first ends and/or second ends of adjacent filament structures may be connected to each other. As described in the fourth embodiment, the second ends of the two filament structures are connected to each other, and the first ends of the two filament structures are connected to the positive and negative electrodes respectively. Therefore, those skilled in the art can set a variety of different electrical connection methods as needed, such as in parallel, in series, or in disconnection, etc. Thus the control of the light-emitting elements on the filament is more convenient, achieving diversified control.

Moreover, since each filament substrate winds around the axis, each filament substrate can achieve 360-degree multi-angle and multi-directional illumination. Therefore, multiple filament substrates with different color temperatures can be set as needed, or a variety of filament substrates with different luminous effect can be set as needed, such as blinking, continuous, gradual changing, etc., so as to achieve diversified and intelligent lighting.

The filament structure described above and the bulb having the filament structure are convenient to process and install, achieve multi-angle omni-directional illumination, and meet the requirements of heat dissipation. The filament structure has an attractive appearance that is easily used for decoration. The structure also enables multiple light-emitting elements at a filament to form multiple structures connected in parallel or in series, separate or simultaneous control of the light-emitting elements, and realizes arrangement of light-emitting elements of multiple colors, thereby achieving multiple lighting effects.

Although the preferred embodiments of the present invention have been described above in detail, the person skilled in the art should clearly understand that various modification and alteration to the present invention are possible. Any modification, equivalent replacement and improvement within the spirits and principles of the present invention all fall into the protection scope of the present invention.

The invention claimed is:

1. A filament structure comprising at least three filament substrates, characterized in that:

each of the at least three filament substrates has a first end and a second end, wherein the first end and the second end of a same filament substrate are spaced apart from each other;

sections between the first ends and the second ends of the at least three filament substrates extend and wind around an axis respectively; and an angle at which the sections of the at least three filament substrates between the first ends and the second ends are wound around the axis is not greater than 720 degrees, wherein each of the at least three filament substrates includes at least one substrate stripe, and wherein the width of the at least one substrate stripe increases gradually or decreases gradually between the first end and the second end.

2. The filament structure according to claim 1, characterized in that:

the at least one substrate stripe extends between the first end and the second end in a fold line, a curved line, a wavy line, or an irregular line.

3. The filament structure according to claim 1, characterized in that: the first ends of the at least three filament substrates are located in a first plane, the second ends of the at least three filament substrates are located in a second plane, and the first plane and the second plane are parallel or not parallel to each other.

4. The filament structure according to claim 1, characterized in that: at least one of the first ends and the second ends of the at least three filament substrates are connected to a connector, or at least one of the first ends and the second ends of the at least three filament substrates are connected to each other.

5. The filament structure according to claim 3, characterized in that:

the first ends and the second ends of the at least three filament substrates are respectively connected to a first connector provided in the first plane and a second connector provided in the second plane; and the first ends of the at least three filament substrates are all connected to the first connector and the second ends of the at least three filament substrates are all connected to the second connector.

6. The filament structure according to claim 5, characterized in that: the first connector and the second connector are arranged coaxially and/or in parallel.

7. The filament structure according to claim 6, characterized in that:

the positions where the first ends of the at least three filament substrates are connected to the first connector are evenly or unevenly distributed along the circumferential direction of the first connector; and the positions where the second ends of the at least three filament substrates are connected to the second connector are evenly or unevenly distributed along the circumferential direction of the second connector.

8. The filament structure according to claim 1, characterized in that: the sections between the first ends and the second ends of the at least three filament substrates extend in a spiral smooth curve.

9. The filament structure according to claim 1, characterized in that: the axis around which the sections between the first ends and the second ends of each of the at least three filament substrates extend and wind are parallel to each other, coincided, or at a certain angle.

10. The filament structure according to claim 9, characterized in that: the at least three filament substrates are provided with a plurality of LED light-emitting elements, and the outside of the filament substrate and the LED light-emitting elements are covered with a medium layer serving for protection or light emitting.

11. A bulb, comprising a filament structure, a lamp holder and a lamp post arranged on the lamp holder, the lamp post being connected to a positive and negative lead, and the bulb comprising at least one filament structure, characterized in that:

the positive and negative lead is connected to at least one filament structure; and a light-transmitting lamp body is provided to house the lamp post and the filament structure;

the filament structure further comprising the at least three filament substrates, each of the at least three filament substrates has a first end and a second end which are spaced apart from each other;

sections between the first ends and the second ends of the at least three filament substrates extend and wind around an axis respectively; and an angle at which the sections of the at least three filament substrates between the first ends and the second ends are wound around the axis is not greater than 720 degrees, wherein each of the at least three filament substrates includes at least one substrate stripe, and wherein the width of the at least one substrate stripe increases gradually or decreases gradually between the first end and the second end.

12. The bulb according to claim 11, characterized in that:

the bulb comprises at least two filament structures; and the first ends and/or the second ends of at least three filament substrates in the at least two filament structures are connected to each other.

13. The bulb according to claim 12, characterized in that:

the first ends of at least three filament substrates in the two filament structures are connected to the first connector respectively;

the second ends of at least three filament substrates in the two filament structures are connected to a second connector respectively; and the first connectors and/or the second connectors of the two filament structures are at least partially overlapped and connected.

* * * * *